US012618595B2

(12) United States Patent
Yang et al.

(10) Patent No.: US 12,618,595 B2
(45) Date of Patent: May 5, 2026

(54) THREE-DIMENSIONALLY DISTRIBUTED LIQUID ATOMIZATION HEAT EXCHANGER, CONTROL METHOD THEREOF, REFRIGERATION SYSTEM, AND AIR CONDITIONER

(71) Applicant: Beijing Jingkelun Engineering Design and Research Institute Co., Ltd., Beijing (CN)

(72) Inventors: Jianguo Yang, Beijing (CN); Chengjun Zhou, Beijing (CN); Weibo Xie, Beijing (CN); Quanjiang Wang, Beijing (CN); Jianhui Kang, Beijing (CN); Jilong Zhang, Beijing (CN); Hui Zhao, Beijing (CN); Lixuan Hao, Beijing (CN); Tongqin Mao, Beijing (CN); Wenjie Cao, Beijing (CN); Haiying Chao, Beijing (CN); Junzeng Li, Beijing (CN)

(73) Assignee: Beijing Jingkelun Engineering Design and Research Institute Co., Ltd., Beijing (CN)

( * ) Notice: Subject to any disclaimer, the term of this patent is extended or adjusted under 35 U.S.C. 154(b) by 408 days.

(21) Appl. No.: 18/246,164

(22) PCT Filed: Sep. 14, 2021

(86) PCT No.: PCT/CN2021/118126
§ 371 (c)(1),
(2) Date: Mar. 21, 2023

(87) PCT Pub. No.: WO2022/062954
PCT Pub. Date: Mar. 31, 2022

(65) Prior Publication Data

US 2023/0366594 A1 Nov. 16, 2023

(30) Foreign Application Priority Data

Sep. 25, 2020 (CN) ..... 202011021378.1

(51) Int. Cl.
*F25B 39/00* (2006.01)
*F25B 9/00* (2006.01)
*F25B 39/04* (2006.01)

(52) U.S. Cl.
CPC ..... *F25B 39/00* (2013.01); *F25B 9/008* (2013.01); *F25B 39/04* (2013.01); *F25B 2339/041* (2013.01)

(58) Field of Classification Search
CPC ..... F25B 39/00; F25B 49/02; F25B 9/008; F25B 2309/06; F25B 2339/041;
(Continued)

(56) References Cited

U.S. PATENT DOCUMENTS

2003/0071373 A1* 4/2003 Hubbard ..... F28F 25/00 261/DIG. 11
2003/0172669 A1* 9/2003 Tilton ..... H05K 7/20345 257/E23.1

(Continued)

FOREIGN PATENT DOCUMENTS

CN 107606928 A 1/2018
CN 207299299 U 5/2018

(Continued)

OTHER PUBLICATIONS

International Search Report and Written Opinion for PCT/CN2021/118126, dated Dec. 15, 2021, 9 pages, including English translation of Search Report.

(Continued)

*Primary Examiner* — Len Tran
*Assistant Examiner* — Kamran Tavakoldavani
(74) *Attorney, Agent, or Firm* — Schwabe, Williamson & Wyatt, P.C.

(57) ABSTRACT

A three-dimensionally distributed liquid atomization heat exchanger includes a housing, an air extraction device, a heat exchange device and a liquid atomization device. The air extraction device is used for forming negative pressure in the housing. The liquid atomization device comprises a liquid supply pipe, atomization discharge pipes and atomization heads. The atomization discharge pipes are connected to the liquid supply pipe. The atomization heads are arranged on the atomization discharge pipes. The atomization discharge pipes are three-dimensionally distributed in the housing. Control devices are arranged on the atomization heads to control the atomization heads to be opened or closed. The control devices are connected to a control center which can, according to a preset time, a preset percentage of (Continued)

the atomization heads which are open and a randomization function, select randomly the atomization heads to be opened or closed.

14 Claims, 4 Drawing Sheets

(58) Field of Classification Search
CPC ..... F25B 2500/09; F25B 39/04; F25B 2339/047; F28D 1/0477; F28D 5/00; F28D 5/02; F24F 13/30; F24F 5/001; F24F 5/0035; F24F 1/039; F24F 2006/146; F28F 25/02; F28F 25/06
See application file for complete search history.

(56) References Cited

U.S. PATENT DOCUMENTS

| | | | | |
|---|---|---|---|---|
| 2007/0151278 | A1* | 7/2007 | Jarvis | F24F 1/0007 62/310 |
| 2011/0023506 | A1 | 2/2011 | Day et al. | |
| 2011/0115223 | A1* | 5/2011 | Stahlkopf | H02P 9/04 290/7 |
| 2017/0010051 | A1* | 1/2017 | Connolly | F25B 30/02 |
| 2020/0200476 | A1* | 6/2020 | Satou | F28D 1/05383 |
| 2021/0107027 | A1* | 4/2021 | Ochi | B05B 17/06 |
| 2021/0388765 | A1* | 12/2021 | Prakash | F28B 11/00 |
| 2022/0252351 | A1 | 8/2022 | Yang et al. | |
| 2022/0373214 | A1* | 11/2022 | Komatsu | F24F 11/89 |

FOREIGN PATENT DOCUMENTS

| | | | |
|---|---|---|---|
| CN | 108994087 | A | 12/2018 |
| CN | 109908440 | A | 6/2019 |
| CN | 110319613 | A | 10/2019 |
| CN | 110319716 | A | 10/2019 |
| CN | 110896831 | A | 3/2020 |
| CN | 110906047 | A | 3/2020 |
| CN | 210952468 | U | 7/2020 |
| JP | S5777864 | A | 5/1982 |
| JP | H09243213 | A | 9/1997 |
| JP | 2007271211 | A | 10/2007 |
| JP | 2008128500 | A | 6/2008 |
| JP | 2013111512 | A | 6/2013 |
| JP | 3186600 | U | 10/2013 |
| JP | 2021520298 | A | 8/2021 |

OTHER PUBLICATIONS

Japan Patent Office, Office Action for JP Patent Application No. 2023-518922, dated May 14, 2024, 16 pages.
European Patent Office, Extended European Search Report in EP Application No. 21871325.3, dated Oct. 14, 2024, 9 pages.

* cited by examiner

THREE-DIMENSIONALLY DISTRIBUTED LIQUID ATOMIZATION HEAT EXCHANGER, CONTROL METHOD THEREOF, REFRIGERATION SYSTEM, AND AIR CONDITIONER

CROSS-REFERENCE TO RELATED APPLICATION

The present application is a national phase entry under 35 U.S.C. § 371 of International Application No. PCT/CN2021/118126, filed on Sep. 14, 2021, which designates the United States of America, which claims priority to Chinese Patent Application No. 202011021378.1, titled "THREE-DIMENSIONALLY DISTRIBUTED LIQUID ATOMIZATION HEAT EXCHANGER, CONTROL METHOD THEREOF, REFRIGERATION SYSTEM, AND AIR CONDITIONER", filed with the China National Intellectual Property Administration on Sep. 25, 2020, the entire disclosures of each of these applications are hereby incorporated by reference in their entireties and for all purposes.

FIELD

The present application relates to the technical field of heat exchanger, and in particular to a three-dimensionally distributed liquid atomization heat exchanger, a control method thereof, a refrigeration system, and an air conditioner.

BACKGROUND

At present, the air-conditioning energy consumption of commercial buildings in China is relatively high. With the development of energy saving technology and further improvement of building energy saving requirements, the disadvantages of traditional commercial air conditioning systems are becoming more and more apparent. In terms of refrigerant, Freon is currently used as refrigerant in air conditioning systems at home and abroad, but Freon may destroy the ozone layer of the atmosphere and have a high greenhouse effect. Because of the instability and high cost of ammonia (R77), there may be unsafe factors in the refrigeration system, so ammonia (R717) is not suitable as the refrigerant for air conditioning. In terms of system installation, conventional air conditioning systems are usually water source heat pump units or air source heat pump units. Water is used as the refrigerant carrier to be transported to the end fan coil to provide the required cooling or heat for the building. The system structure is complex, and besides refrigeration equipment, a water circulation system needs to be provided. After the secondary heat exchange between the refrigerant and water, the water is delivered to the user through the water pump for use. This design requires large equipment rooms, takes up building space, increases investment, and also has problems such as high energy consumption per unit area and low system efficiency.

As an efficient, energy-saving and environment-friendly refrigerant, carbon dioxide has a wide application prospect and considerable economic value. However, due to the inherent characteristics of carbon dioxide, when the operating temperature is higher than the critical temperature, no matter how high the pressure is applied, carbon dioxide cannot be liquefied. There has always been a prejudice in the field that a refrigeration system with carbon dioxide as the medium alone cannot be used for large-scale refrigeration. This greatly reduces the refrigeration efficiency of carbon dioxide refrigeration system and limits the popularization and application of carbon dioxide refrigeration system.

An existing air-cooled heat exchanger and evaporative cooling heat exchanger need to introduce air from the outside, when the outside temperature and humidity are high, the heat transfer effect is influenced by the temperature and humidity of the outside natural wind, and the influence is great. Especially in hot and humid areas, this kind of heat exchanger still has poor refrigeration effect, and the energy consumption thereof is large, which is hard to meet the refrigeration demand. Furthermore, current heat exchangers are generally turned on or off together, but in the actual use process, in order to make full use of energy, it is often not necessary to turn on all the heat exchangers. The technical solution of the present application is proposed to solve the problem of conventional condensation methods being difficult to liquefy and condense carbon dioxide, improve the overall efficiency of the carbon dioxide system, make the environmental protection working medium carbon dioxide widely used in practical projects, and save energy and environmental protection.

SUMMARY

An object according to the present application is to overcome the shortcomings of the conventional technology and provide a three-dimensional distributed liquid atomization heat exchanger with energy saving, environmental protection, high heat exchange efficiency and easy control, and a control method thereof. A refrigeration system and a central air conditioner comprising the three-dimensional distributed liquid atomization heat exchanger are further provided according to the present application.

The technical solution of the three-dimensional distributed liquid atomization heat exchanger provided by the present application is as follows.

A three-dimensional distributed liquid atomization heat exchanger includes a shell, an air extraction device, a heat exchange device and a liquid atomization device. The air extraction device is arranged outside the shell and used for forming negative pressure in the shell; the heat exchange device and the liquid atomization device are arranged in the shell; the liquid atomization device includes a liquid supply pipe, multiple atomization exhaust pipes and multiple atomization heads, the multiple atomization exhaust pipes are connected with the liquid supply pipe, and the multiple atomization head are arranged on the multiple atomization exhaust pipes, the multiple atomization exhaust pipe are arranged in the shell in a three-dimensional distributed manner, the multiple atomization heads are provided with a control device to control the opening or closing of each atomization head, and the control device is connected to the control center.

Preferably, the control center can randomly select the atomization head to be opened or closed according to the set time, the set open percentage of the multiple atomization heads, and the random function. The opening or closing of each atomization head is random, so that the atomized liquid in the shell is evenly distributed; the control center is an intelligent computer.

Preferably, a heat exchange device is arranged around the atomization head, and the heat exchange device is used for circulating refrigerant, the atomization head is used to spray the atomized liquid, the atomized liquid diffuses around the heat exchange device, under the action of negative pressure, the liquid micelle and the carbon dioxide in the heat exchange device complete the radiation heat transfer and are extracted from the shell by the air extraction device.

Preferably, during refrigeration, water micelles in the cavity absorb the radiant heat of carbon dioxide circulating in the heat exchange device, and then water micelles are dynamically and continuously decomposed into small micelles, so as to take away the heat and condense and liquefy the carbon dioxide refrigerant.

Preferably, the multiple atomization exhaust pipe are arranged in a matrix form in layers, and multiple atomization heads are arranged on the atomization exhaust pipe.

Preferably, the heat exchange device is formed by stacking multiple heat exchange units, the heat exchange unit includes multiple rows of pipes for circulating carbon dioxide and fins for fixing multiple rows of pipes, the multiple rows of pipes and fins are fixed by a fixing frame, carbon dioxide flows in from the inlet end and is discharged from the outlet end; an atomization exhaust pipe is arranged in the heat exchange unit.

Preferably, the multiple rows of pipes of multiple heat exchange units are stacked and connected in series, the heat exchange unit is fixed on the shell, and the multiple atomization exhaust pipes are respectively connected to the liquid supply pipes.

Preferably, a control device for controlling the opening or closing of the multiple atomization exhaust pipes is arranged on the multiple atomization exhaust pipes. The control device is connected to the control center, and the control center is an intelligent computer.

Preferably, the atomization head is an ultrasonic atomizer, which includes an ultrasonic atomization sheet, and the ultrasonic atomization sheet and ultrasonic waves are used to atomize water.

The water vapor after heat exchange is not recycled, and is discharged directly into the atmosphere.

Preferably, the air extraction device is a negative pressure fan, a magnetic suspension negative pressure fan or a vacuum air extraction pump.

Preferably, the shell is a closed shell, and the air extraction device can form a set negative pressure value in the closed shell to realize more efficient heat exchange;

the exhaust amount of the air extraction device is greater than the evaporation amount of atomized liquid in the shell, on one hand, the vapor in the shell can be fully discharged, and the evaporation efficiency of atomized liquid can be improved. On the other hand, the negative pressure environment in the shell can be maintained.

Preferably, the heat exchanger includes a pressure regulating device, the air inlet of the pressure regulating device is arranged outside the shell, and the air outlet of the pressure regulating device is arranged inside the shell. The regulated air flow can be sent into the shell through the pressure regulating device to promote the flow of vapor in the shell and form aerosol in the shell.

Preferably, the liquid supply pipe is communicated with the liquid tank outside the shell and continuously supplies liquid into the shell;

the liquid is softened water, which removes inorganic salts such as calcium and magnesium, reduces the entry of external impurities, avoids the scaling of condenser pipes to the greatest extent, and prolongs the service life of heat exchange pipes.

A control method of a three-dimensional distributed liquid atomization heat exchanger, an atomization head is arranged in a shell of the heat exchanger in a three-dimensional distribution manner, a control center codes a control device on the atomization head, when the heat exchanger does not need to operate at full load, the open percentage of the atomization head is input, the control center selects the atomization head that needs to be opened or closed according to the random function every set time, the opening or closing of each atomization head is random to achieve the effect of uniform atomization liquid in the shell.

A refrigeration system, including a compressor, a heat exchanger, a liquid reservoir and an evaporator connected in sequence, the heat exchanger is the above-mentioned three-dimensional distributed liquid atomization heat exchanger.

A carbon dioxide multi-split central air conditioner, including an indoor heat exchanger and an outdoor unit, the outdoor unit is connected with the indoor heat exchanger through a pipeline; the outdoor unit includes a carbon dioxide compressor, a liquid reservoir and a heat exchanger. The central air conditioner uses carbon dioxide as a single cycle working medium, the heat exchanger is the above three-dimensional distributed liquid atomization heat exchanger.

The implementation of the present application includes the following technical effects.

The control center of the three-dimensional distributed liquid atomization heat exchanger can randomly select the atomization head to be opened or closed according to a set time (for example, 1 second to 300 seconds) and a set open percentage of atomization head (for example, 10% to 95% atomization head) and a random function, the opening or closing of each atomization head is random to achieve the effect of uniform atomization liquid in the shell. The control center can accurately control the atomization head and avoid the waste of energy at the same time.

A heat exchange device is arranged around the atomization head, and the heat exchange device is used for circulating refrigerant, the atomization head is used for spraying atomized liquid, and the atomized liquid diffuses around the heat exchange device. Under the action of negative pressure, the liquid micelle and the carbon dioxide in the heat exchange device complete the radiation heat transfer and are extracted from the shell by the air extraction device, during refrigeration, the water micelles in the cavity absorb the radiant heat of carbon dioxide circulating in the heat exchange device, and then the water micelles are gradually decomposed into small micelles, so as to take away the heat and condense and liquefy the carbon dioxide refrigerant. Water micelles are dynamically and continuously decomposed into small water micelles, which take away heat.

The rows of pipes of multiple heat exchange units are stacked and connected in series, the heat exchange unit is fixed on the shell, and the atomization exhaust pipes are respectively connected to the liquid supply pipes. The heat exchange device is arranged in a way that multiple heat exchange units are stacked, which is convenient for installation and maintenance. When a certain heat exchange unit is broken, the broken heat exchange unit can be removed for maintenance or replacement. It is also convenient to expand or reduce the size of the heat exchange device, which simplifies the preparation process.

In the heat exchanger of the present application, under the condition of negative pressure, aerosol is gradually decomposed into small and micro clusters under the condition of absorbing radiant heat for heat exchange, except for the pressure regulating device, no external air enters the heat exchanger. The high temperature and high humidity conditions do not affect the heat transfer, and the flash heat exchanger can be used normally under different climatic conditions.

The carbon dioxide multi-split central air conditioner of the present application has the advantages of large pressure difference, good fluidity, small density, and trans-critical phase change in view of using carbon dioxide as the circulating working medium, the central air conditioner can be used in high-rise buildings, and can complete circulation at a height of more than 100 meters, the existing Freon multi-line central air conditioner can't be used in high-rise buildings. Besides, the existing refrigerant needs to be equipped with a circulating pump, which consumes energy and has high cost. Compared with the traditional air conditioner, the central air conditioner of the present application can improve the efficiency by more than 2 times and save energy by more than 50%.

Figure 1:
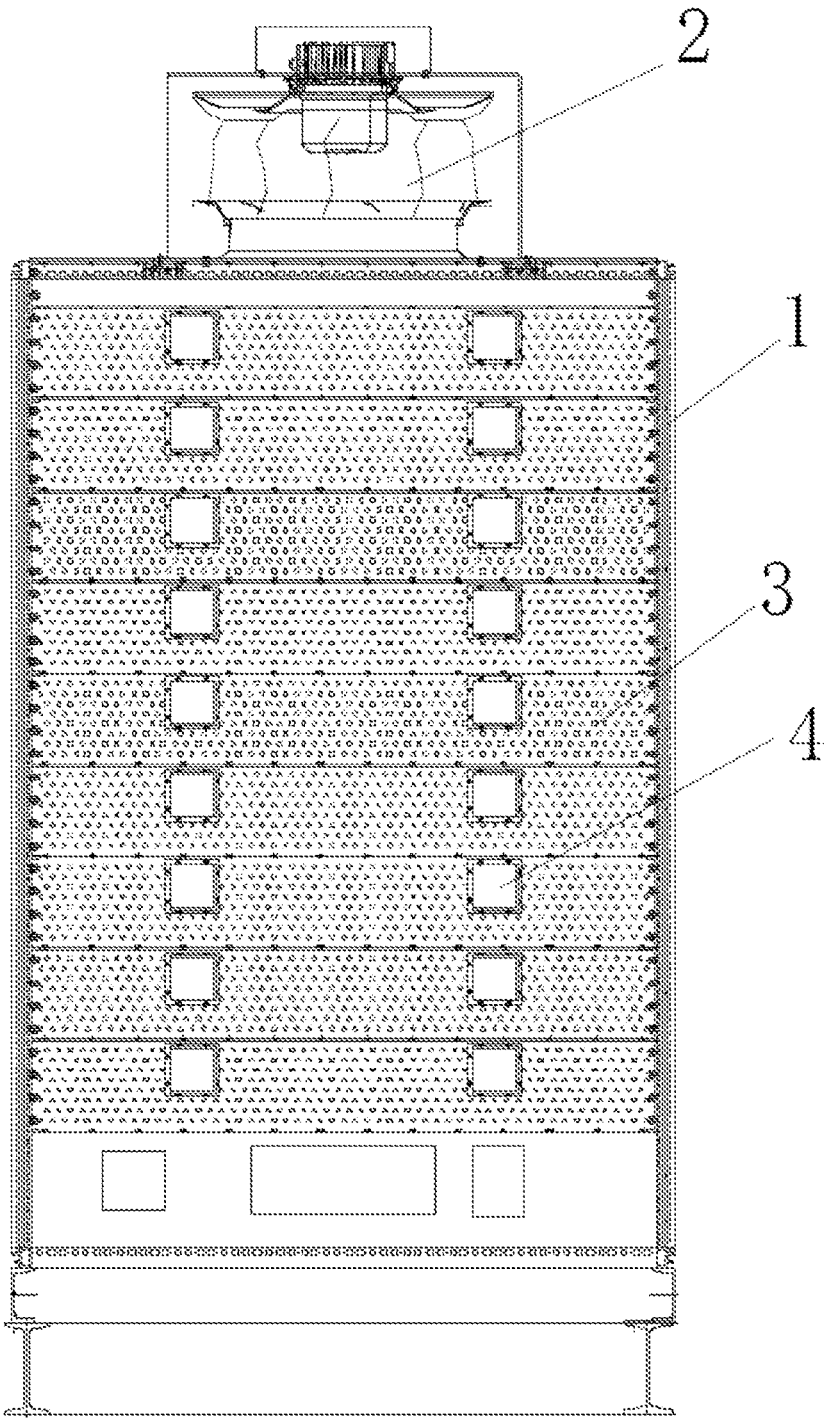
FIG. 1 is a schematic cross-sectional view of a three-dimensional distributed liquid atomization heat exchanger according to an embodiment of the present application.

Reference numerals in the drawings: 1, shell; 2, air extraction device; 3, heat exchange device; 4, atomization exhaust pipe; 5, atomization head; 6, heat exchange unit; 60, multi-row pipe; 61, fins; 62, fixing frame; 7, compressor; 8, heat exchanger; 9, liquid reservoir; 10, evaporator.

DETAILED DESCRIPTION OF THE EMBODIMENTS

The present application is described in detail below with reference to the embodiments and the drawings. It should be noted that the described embodiments are only intended to facilitate the understanding of the present application and do not limit the present application.

Referring to FIG. 1 to FIG. 4, the three-dimensional distributed liquid atomization heat exchanger provided by this embodiment includes a shell 1, an air extraction device 2, a heat exchange device 3 and a liquid atomization device. The air extraction device 2 is arranged outside the shell 1 and used for forming negative pressure in the shell 1; the heat exchange device 3 and the liquid atomization device are arranged in the shell 1; the liquid atomization device includes a liquid supply pipe (not shown in the figure), multiple atomization exhaust pipes 4, and multiple atomization heads 5. The atomization exhaust pipes 4 are connected with the liquid supply pipe, and the multiple atomization heads 5 are arranged on the multiple atomization exhaust pipes 4, the multiple atomization exhaust pipes 4 are arranged in the shell 1 in a three-dimensional distributed manner, a control device for controlling the opening or closing of each atomization head 5 is arranged on the atomization head 5. The control device is connected to the control center, and the control center is an intelligent computer. The control center can randomly select the atomization heads 5 to be opened or closed according to a set time (for example, 1 second to 300 seconds) and a set opening ratio (for example, 10% to 95% of the multiple atomization heads 5) of the multiple atomization heads 5 and a random function, the opening or closing of each atomization head 5 is random to achieve the effect of uniform atomization liquid in the shell 1. The control center can accurately control the atomization head and avoid the waste of energy at the same time.

Specifically, as shown in FIG. 1, a heat exchange device 3 is arranged around each atomization head 5, and the heat exchange device 3 is used for circulating refrigerant, the atomization head 5 is used for spraying atomized liquid, and the atomized liquid diffuses around the heat exchange device 3. Under the action of negative pressure, the liquid micelle and the carbon dioxide in the heat exchange device 3 complete the radiation heat transfer and are extracted from the shell 1 by the air extraction device 2. During refrigeration, the water micelles in the cavity absorb the radiant heat of carbon dioxide circulating in the heat exchange device 3, and then the water micelles are gradually decomposed into small micelles, so as to take away the heat and condense and liquefy the carbon dioxide refrigerant. Water micelles are dynamically and continuously decomposed into small water micelles, which take away heat.

Referring to FIG. 1, the multiple atomization exhaust pipes 4 are arranged in a matrix form in layers, and at least two atomization heads 5 are arranged on each atomization exhaust pipe 4. As an example, an atomization matrix with 18 rows*12 holes can be specifically selected. Referring to FIG. 1, eighteen atomization exhaust pipes 4 are arranged in the shell 1 of the heat exchanger, which are arranged in nine layers. There are 12 atomization heads 5 in each row of atomization exhaust pipes 4, with a total of 216 atomization heads 5. Each atomization head 5 is provided with a control device capable of controlling its opening or closing, and the control device is connected to the control center. In the actual operation process, when only 50% of the spray heads need to be turned on to meet the cooling or heating requirements, the existing practice is to close the atomization exhaust pipes 4 in the whole row. If this operation is carried out, the atomized liquid in the shell 1 may be unevenly distributed, affecting the heat transfer effect; if 108 atomization heads 5 are closed manually, it may also bring uneven problems, and the operation is inconvenient. In the present application, 108 atomization heads 5 can be randomly closed at a certain interval (for example, 30 seconds) in the control center, which makes each atomization head 5 have the same probability of being open or closed at random, the atomized liquid in the shell 1 may always be in a uniform state.

Figure 2:
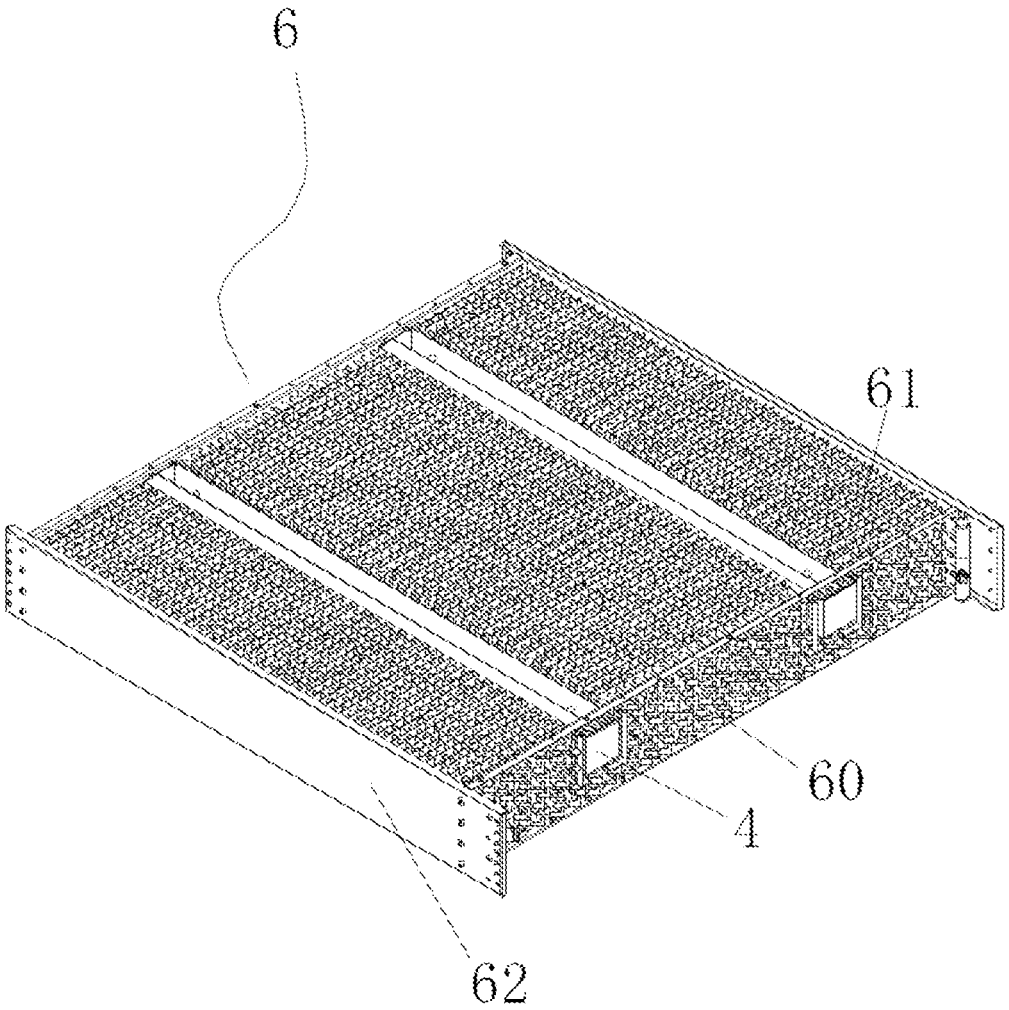
FIG. 2 shows a three-dimensional structure of a heat exchange unit.
Figure 3:
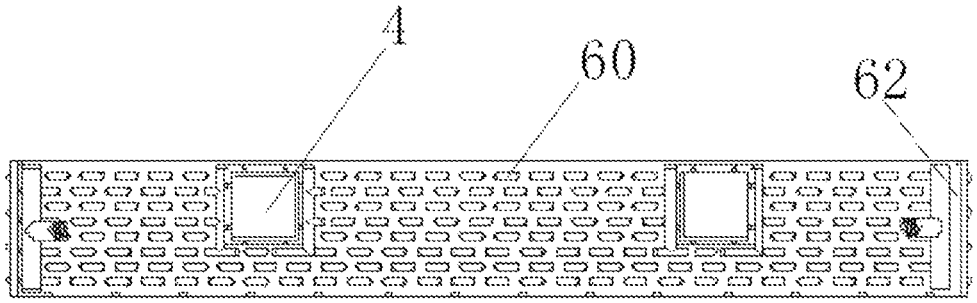
FIG. 3 shows a front structure of the heat exchange unit.
Figure 4:
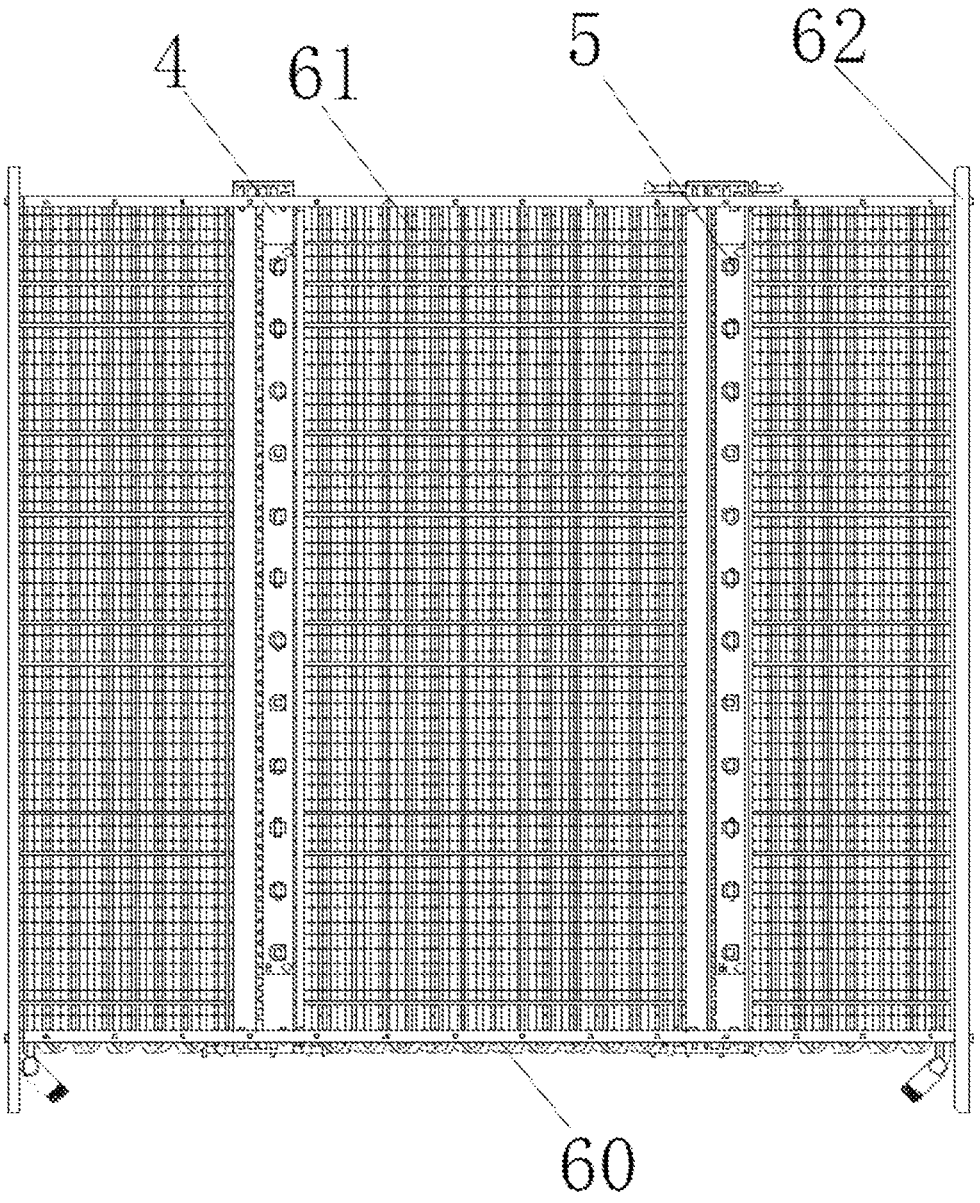
FIG. 4 shows a top structure of the heat exchange unit.

Referring to FIG. 2 to FIG. 4, the heat exchange device 3 is formed by stacking multiple heat exchange units 6, the heat exchange unit 6 includes multiple rows of pipes 60 for circulating carbon dioxide and fins 61 for fixing multiple rows of pipes 60, the multiple rows of pipes 60 and fins 61 are fixed by a fixing frame 62, carbon dioxide flows in from an inlet end and is discharged from an outlet end; an atomization exhaust pipe 4 is arranged in the heat exchange unit 6. The rows of pipes 60 of multiple heat exchange units 6 are stacked and connected in series, the heat exchange unit 6 is fixed on the shell 1, and the atomization exhaust pipes 4 are respectively connected to the liquid supply pipes. The heat exchange device 3 is arranged in a way that multiple heat exchange units 6 are stacked, which is convenient for installation and maintenance. When a certain heat exchange unit 6 is broken, the broken heat exchange unit can be removed for maintenance or replacement. It is also convenient to expand or reduce the size of the heat exchange device 3, which simplifies the preparation process.

Further, a control device for controlling the opening or closing of each atomization exhaust pipe 4 is arranged on the atomization exhaust pipe 4. The control device is connected to the control center, and the control center is an intelligent computer. The control center can independently control the whole atomization head 5 and the atomization exhaust pipe 4, and the control mode is flexible and convenient.

The atomization head 5 can be an ultrasonic atomizer, which includes an ultrasonic atomization sheet, and the ultrasonic atomization sheet cooperates with ultrasonic waves to atomize water. Ultrasonic atomizing water itself has the function of descaling to avoid scaling on the surfaces of heat exchange pipes and fins 61. Water vapor and unevaporated water mist are directly discharged into the atmosphere. The water vapor after heat exchange is not recycled, and is discharged directly into the atmosphere, because heat is mainly converted into internal energy in the process of water micelle decomposition, the temperature of discharged water vapor is not high, and the heat island effect may not occur. The air extraction device is a negative pressure fan, a magnetic suspension negative pressure fan or a vacuum air extraction pump.

Specifically, the shell 1 is a closed shell, and the air extraction device 2 can form a set negative pressure value in the closed shell to realize more efficient heat exchange. The exhaust amount of the air extraction device 2 is greater than the evaporation amount of atomized liquid in the shell 1; on one hand, the vapor in the housing 1 can be fully discharged, so as to improve the evaporation efficiency of the atomized liquid, and on the other hand, the negative-pressure environment in the housing 1 can be maintained. The heat exchanger further includes a pressure regulating device, and the air inlet of the pressure regulating device is arranged outside the shell 1, the air outlet of the pressure regulating device is arranged in the shell 1, the regulated air flow can be sent into the shell 1 through the pressure regulating device to promote the flow of vapor in the shell 1 and form aerosol in the shell 1. The pressure regulating device may be one or more fans, the one or more fans are arranged close to the bottom of the shell 1, and the rotation of the one or more fans promotes the flow of the vapor and the atomized liquid in the shell 1. It should be noted that, different from the existing air-cooled heat exchanger and evaporative cooling heat exchanger, in the heat exchanger of the present application, under the condition of negative pressure, aerosol is gradually decomposed into small and micro clusters under the condition of absorbing radiant heat for heat exchange, except for the pressure regulating device, no external air enters the heat exchanger. The high temperature and high humidity conditions do not affect the heat transfer, and the flash heat exchanger can be used normally under different climatic conditions.

Specifically, the liquid supply pipe is communicated with a liquid tank (not shown in the figure) or a liquid pipe outside the shell 1 to continuously supply liquid into the shell 1; the liquid supply pipe may be a single linear pipeline, or two or more pipelines arranged side by side, or a single pipeline arranged in a coil shape.

The liquid in the present application preferentially uses water, preferably softened water, which removes inorganic salts such as calcium and magnesium, reduces the entry of external impurities, avoids the scaling of condenser pipes to the greatest extent, and increases the service life of heat exchange pipes. The liquid atomization device atomizes each drop of water into a droplet of about 1/500 of an original water drop volume, to form micro or nanometer water mist, which increases a contact area with the air and accelerates the evaporation velocity by more than 300 times; the heat absorbed by the refined water droplets from liquid to gas is about 540 times the heat absorbed by the water when the water is heated by 1 degree Celsius, which can absorb a large amount of heat and greatly enhance the heat exchange effect.

A control method of a three-dimensional distributed liquid atomization heat exchanger is further provided in this embodiment, the multiple atomization head 5 are arranged in the shell 1 of the heat exchanger in a three-dimensional distribution manner, the control center codes the control device on the multiple atomization heads 5, when the heat exchanger does not need to operate at full load, the open percentage of the multiple atomization heads 5 is input, the control center selects the atomization heads 5 that needs to be opened or closed according to the random function every set time, the opening or closing of each atomization head 5 is random to achieve the effect of uniform atomization liquid in the shell 1. The existing random function can be selected as the random function, which is not limited by the present application and is not described in detail. The three-dimensional distribution mode refers to the hierarchical arrangement mode in the form of matrix.

Figure 5:
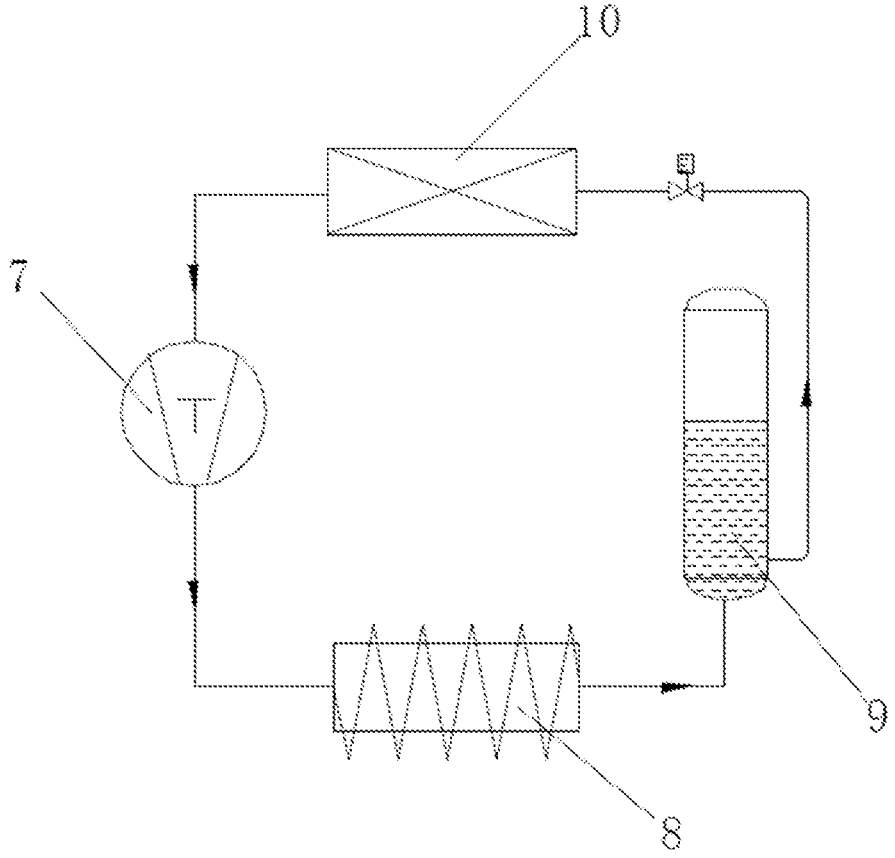
FIG. 5 is a schematic diagram of a refrigeration system with the three-dimensional distributed liquid atomization heat exchanger.

Referring to FIG. 5, a refrigeration system is further provided in this embodiment, including a compressor 7, a heat exchanger 8, a liquid reservoir 9 and an evaporator 10 connected in sequence, the heat exchanger 8 is the above three-dimensional distributed liquid atomization heat exchanger.

A carbon dioxide multi-split central air conditioner is further provided in this embodiment, including an indoor heat exchanger and an outdoor unit, the outdoor unit is connected with the indoor heat exchanger through a pipeline, the outdoor unit includes a carbon dioxide compressor, a liquid reservoir and an outdoor heat exchanger. The central air conditioner uses carbon dioxide as a single cycle working medium, and the outdoor heat exchanger is the above-mentioned three-dimensional distributed liquid atomization heat exchanger.

In the cooling mode, the carbon dioxide medium passes through carbon dioxide compressor, outdoor heat exchanger, liquid reservoir and indoor heat exchanger in turn to complete refrigeration. In the heating mode, the carbon dioxide medium passes through the carbon dioxide compressor, the indoor heat exchanger, the liquid accumulator and the outdoor heat exchange in turn to complete heating. The reversing of cooling and heating can be realized through the four-way reversing valve, which is not repeated in this embodiment. As a circulating working medium, carbon dioxide has the advantages of large pressure difference, good fluidity, low density and trans critical phase change, and can be used in high-rise buildings, and can complete circulation at a height of more than 100 meters, the existing Freon multi-line central air conditioner can't be used in high-rise buildings. Besides, the existing refrigerant needs to be equipped with a circulating pump, which consumes energy and has high cost. Compared with the traditional air conditioner, the central air conditioner of the present application can improve the efficiency by more than 2 times and save energy by more than 50%.

Finally, it should be noted that, the above embodiments are only used for illustration of the technical solutions of the present application rather than limitation to the protection scope of the present application. Although the present application has been illustrated in detail with reference to the preferred embodiments, it should be understood by those skilled in the art that, modifications or equivalent replacements may be made to the technical solutions of the present application without departing from the essence and scope of the present application.

The invention claimed is:

1. A three-dimensional distributed liquid atomization heat exchanger, comprising a shell, an air extraction device, a heat exchange device and a liquid atomization device, wherein the air extraction device is arranged outside the shell and used for forming negative pressure in the shell; the heat exchange device and the liquid atomization device are arranged in the shell; the liquid atomization device comprises a plurality of atomization exhaust pipes and a plurality of atomization heads, and the plurality of atomization heads are arranged on the plurality of atomization exhaust pipes, the atomization exhaust pipes are arranged in the shell in a three-dimensional distributed manner, the plurality of atomization heads are provided with a control device to control the opening or closing of the plurality of atomization heads, and the control device is connected to a control center, wherein the control center is configured to randomly select the atomization heads to be opened or closed according to the set time, the set open percentage of the atomization heads, and the random function, the opening or closing of each atomization head is random to allow the atomized liquid in the shell to be evenly distributed; the control center is an intelligent computer.

2. The three-dimensional distributed liquid atomization heat exchanger according to claim 1, wherein the heat exchange device is arranged around each atomization head, and the heat exchange device is used for circulating refrigerant, the atomization head is used for spraying atomized liquid, and the atomized liquid diffuses around the heat exchange device, under the action of negative pressure, liquid micelles and carbon dioxide in the heat exchange device complete the radiation heat transfer and are extracted from the shell by the air extraction device.

3. The three-dimensional distributed liquid atomization heat exchanger according to claim 2, wherein during refrigeration, water micelles in the cavity absorb radiant heat of carbon dioxide circulating in the heat exchange device, and then water micelles are dynamically and continuously decomposed into small micelles, so as to take away the heat and condense and liquefy the carbon dioxide refrigerant.

4. The three-dimensional distributed liquid atomization heat exchanger according to claim 1, wherein the plurality of atomization exhaust pipes is arranged in a matrix form in layers, and at least two atomization heads are arranged on each atomization exhaust pipe.

5. The three-dimensional distributed liquid atomization heat exchanger according to claim 1, wherein the heat exchange device is formed by stacking a plurality of heat exchange units, the heat exchange unit comprises a plurality of rows of pipes for circulating carbon dioxide and fins for fixing the rows of pipes, the plurality of rows of pipes and fins are fixed by a fixing frame, carbon dioxide flows in from an inlet end and is discharged from an outlet end; an atomization exhaust pipe is arranged in the heat exchange unit.

6. The three-dimensional distributed liquid atomization heat exchanger according to claim 5, wherein the plurality of rows of pipes of a plurality of heat exchange units is stacked and connected in series, the heat exchange unit is fixed on the shell.

7. The three-dimensional distributed liquid atomization heat exchanger according to claim 1, wherein the control device is arranged on each atomization exhaust pipe for controlling the opening or closing of the atomization exhaust pipe, the control device is connected to the control center, and the control center is an intelligent computer.

8. The three-dimensional distributed liquid atomization heat exchanger according to claim 1, wherein the atomization head is an ultrasonic atomizer, which comprises an ultrasonic atomization sheet, and the ultrasonic atomization sheet and ultrasonic waves are used to atomize water;

wherein the water vapor after heat exchange is not recycled, and is discharged directly into the atmosphere.

9. The three-dimensional distributed liquid atomization heat exchanger according to claim 1, wherein the air extraction device is a negative pressure fan, a magnetic suspension negative pressure fan or a vacuum air extraction pump.

10. The three-dimensional distributed liquid atomization heat exchanger according to claim 1, wherein the shell is a closed shell, and the air extraction device is configured to form a set negative pressure value in the closed shell to realize efficient heat exchange;

wherein an exhaust amount of the air extraction device is greater than an evaporation amount of atomized liquid in the shell, on one hand, the vapor in the shell is fully discharged, so as to improve the evaporation efficiency of the atomized liquid, and on the other hand, the negative-pressure environment in the shell is maintained.

11. The three-dimensional distributed liquid atomization heat exchanger according to claim 1, wherein the heat exchanger comprises a pressure regulating device, an air inlet of the pressure regulating device is arranged outside the shell, and an air outlet of the pressure regulating device is arranged inside the shell, the regulated air flow is allow to be sent into the shell through the pressure regulating device to promote the flow of vapor in the shell and form aerosol in the shell.

12. The three-dimensional distributed liquid atomization heat exchanger according to claim 1, wherein the liquid is softened water, which removes inorganic salts such as calcium and magnesium, reduces the entry of external impurities, avoids the scaling of condenser pipes to the greatest extent, and prolongs the service life of heat exchange pipes.

13. A refrigeration system, comprising a compressor, a heat exchanger, a liquid reservoir and an evaporator connected in sequence, wherein the heat exchanger is a three-dimensional distributed liquid atomization heat exchanger according to claim 1.

14. A carbon dioxide multi-split central air conditioner, comprising an indoor heat exchanger and an outdoor unit, wherein the outdoor unit is connected with the indoor heat exchanger through a pipeline, the outdoor unit comprises a carbon dioxide compressor, a liquid reservoir and a heat exchanger, the central air conditioner uses carbon dioxide as a single cycle working medium, wherein the heat exchanger is a three-dimensional distributed liquid atomization heat exchanger according to claim 1.

* * * * *